US005875637A

United States Patent [19]

Paetow

[11] Patent Number: 5,875,637

[45] Date of Patent: Mar. 2, 1999

[54] METHOD AND APPARATUS FOR APPLYING DUAL CENTRIFUGAL COMPRESSORS TO A REFRIGERATION CHILLER UNIT

[75] Inventor: Herman E. Paetow, Spring Grove, Pa.

[73] Assignee: York International Corporation, York, Pa.

[21] Appl. No.: 900,575

[22] Filed: Jul. 25, 1997

[51] Int. Cl.[6] ..... F25B 5/00

[52] U.S. Cl. ..... 62/117; 62/175; 62/510

[58] Field of Search ..... 62/175, 510, 117, 62/119

[56] References Cited

U.S. PATENT DOCUMENTS

| | | | |
|---|---|---|---|
| 1,951,915 | 5/1934 | Kägi . | |
| 2,079,687 | 5/1937 | Fourness . | |
| 3,064,449 | 11/1962 | Rigney . | |
| 3,859,820 | 1/1975 | Dobney | 62/510 X |
| 3,885,938 | 5/1975 | Ordonez . | |
| 4,201,065 | 5/1980 | Griffin . | |
| 4,309,876 | 1/1982 | Leonard et al. | 62/175 X |
| 4,506,516 | 3/1985 | Lord | 62/175 X |
| 4,646,530 | 3/1987 | Huenniger | 62/175 |
| 4,777,805 | 10/1988 | Hashizume . | |
| 4,976,116 | 12/1990 | Hayama et al. . | |
| 5,265,434 | 11/1993 | Alsenz . | |

FOREIGN PATENT DOCUMENTS

| | | |
|---|---|---|
| 2-238270 | 9/1990 | Japan . |
| 4-36574 | 2/1992 | Japan . |
| 106435 | 11/1963 | Netherlands . |
| 138106 | 4/1930 | Switzerland . |
| 1179957 | 10/1964 | United Kingdom . |

*Primary Examiner*—Henry Bennett
*Assistant Examiner*—Susanne C. Tinker
*Attorney, Agent, or Firm*—Finnegan, Henderson, Farabow, Garrett & Dunner, L.L.P.

[57] ABSTRACT

A system and method of applying dual centrifugal compressors to a single evaporator and a single condenser in a refrigeration chiller unit. The condenser is split into two chambers by a divider having the same cross-sectional shape as the condenser and having holes provided through which the tubing provided in the condenser passes. The condenser includes a valve in fluid communication with both chambers of the compressor, for selectively equalizing or separating the pressures within the respective chambers. One or both compressors can be operated, according to the load. An independent condenser pressure can be provided for each centrifugal compressor, and thus the problems encountered by the conventional parallel-compressor refrigeration system can be avoided. With the invention, the refrigeration chiller capacity can be maximized and also adjusted to accommodate variable load requirements.

12 Claims, 5 Drawing Sheets

METHOD AND APPARATUS FOR APPLYING DUAL CENTRIFUGAL COMPRESSORS TO A REFRIGERATION CHILLER UNIT

BACKGROUND OF THE INVENTION

1. Field of the Invention

The present invention relates generally to centrifugal chillers, and more particularly, to a method and apparatus for applying dual centrifugal compressors to a refrigeration chiller unit.

2. Description of the Related Art

As shown in FIG. 1, a conventional centrifugal chiller 10 includes a single centrifugal compressor 12, a condenser 14, an expansion device 16, and an evaporator 18, all being interconnected in series to form a conventional closed refrigeration circuit. Compressor 12 compresses refrigerant gas and delivers it to condenser 14 where a cooling medium, such as water from a cooling tower, causes the compressed gas to condense to a liquid refrigerant. The liquid refrigerant expands as it is passed through expansion device 16 and travels to evaporator 18. As the liquid refrigerant flows through evaporator 18, circulating water from a building is placed in a heat exchange relationship with the refrigerant so as to cause the water to be chilled and the refrigerant to be vaporized. The refrigerant is then delivered to a suction inlet of the compressor. In this manner, the water is chilled in evaporator 18 for cooling the building. In order to vary the amount of cooling imparted to the building in response to changes in the cooling requirement or load, the capacity of compressor 12 is adjusted, thereby regulating the flow rate of the refrigerant through the refrigeration circuit.

Conventionally, horizontal shell-and-tube condensers are used in centrifugal chillers, often with the refrigerant flowing outside the tubes of the condenser. As generally illustrated in FIG. 2, a plurality of tubes 20 are held within a cylindrical shell 22 of the conventional condenser. The outside surface 24 of each tube 20 is often finned to increase the heat transfer of the refrigerant outside the tubes with water 26 running through the tubes. Furthermore, condensers usually have the cylindrical shell like that shown in FIG. 2.

In order to increase the capacity of centrifugal chiller systems, it has been proposed to provide a refrigeration system with dual compressors. Such systems are discussed in U.S. Pat. No. 4,201,065 to Griffen, and one such system is described in some detail in that patent. Aspects of a prior art dual compressor system are shown in FIG. 3. Compressors 28, 30 are connected to separate circuits in condenser 32. The system includes, expansion valves 36, 38 provided in the lines connecting condenser 32 and evaporator 34.

Condenser 32 includes a plurality of separate and distinct refrigeration tube circuits 40, 42, 44 and 46. Each such circuit includes a plurality of parallel elongated tubes (not shown) that run the length of the condenser and are interconnected by bends at the ends of the condenser. Each circuit in Griffen includes parallel tubes (not shown) extending along the length of condenser 32. Circuits 40 and 42 both transverse the top half of the condenser 32, and circuits 44, 46 transverse the lower half of condenser 32. Compressor 28 therefore feeds refrigerant through a circuit 42 in the top half of the condenser and circuit 46 in the lower half of the condenser. Compressor 30 similarly feeds refrigerant to circuits in both the top and bottom of the compressor. If one compressor is shut off when the refrigeration load decreases, or if the flow of refrigerant through one or more circuit is otherwise cut off, the condenser still utilizes the heat exchanger area of the entire condenser.

In the system shown in Griffen, the refrigerant flows through tubes in the condenser and is cooled by a fluid, typically air, that is placed in heat exchange relationship with the refrigerant to cool it. Similarly, the refrigerant flows through tubes in the evaporator where it is used to cool the water flowing through the evaporator shell.

Conventional dual compressor refrigeration systems typically use conventional positive displacement compressors, such as, reciprocation or screw-type compressors. Conventional positive displacement compressors operate in parallel and have common suction and discharge connections. Centrifugal compressors have variable volume and constant head characteristics, and thus, cannot operate in parallel, unless balanced through control. Thus, in order for centrifugal compressors to be effectively implemented in such dual-compressor systems, a control system must be employed that suitably matches the head characteristics for each centrifugal compressor. However, in practice such head matching is difficult to achieve even with the most sophisticated control systems.

SUMMARY OF THE INVENTION

An object of the invention is to provide an improved refrigeration chiller system with dual centrifugal compressors.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a refrigeration chiller including first and second centrifugal compressors for compressing a vaporous refrigerant, an evaporator for evaporating the refrigerant, and first and second expansion devices for expanding the refrigerant passing therethrough. The refrigeration chiller further comprises a condenser for condensing the refrigerant, the condenser including first and second condensing chambers and a plurality of heat exchanger tubes extending along its length through both of such condensing chambers. The first compressor, the evaporator, the first condensing chamber, and the first expansion device are connected to form a first refrigeration circuit, and the second compressor, the evaporator, the second condensing chamber, and the second expansion device are connected to form a second refrigeration circuit. Both of these circuits directly communicate with each other at the evaporator, but not elsewhere. The first and second chambers are preferably formed by placing a divider between the respective ends of the condenser, the divider having a cross section that is substantially the same, if not the same, as the cross section of the condenser. The divider also includes a plurality of apertures through which the heat exchanger tubes extend from one chamber to the other. The system also preferably includes an equalizing valve in fluid communication with each of the first and second condenser chambers, for equalizing the pressure within both chambers, when desired.

To further achieve the objects of the present invention, the invention comprises a condenser for use in a refrigeration chiller having first and second centrifugal compressors, an evaporator, and first and second expansion devices for expanding a refrigerant passing therethrough. The condenser comprises a shell through which the refrigerant is passed and a plurality of heat transfer tubes extending through the shell. Refrigerant is applied to and flowed through the shell, and a cooling medium such as water passes through the tubes. The heat transfer tubes extend throughout the length of the interior of the shell, and the refrigerant passing through the shell contacts an outer surface of the plurality of heat transfer tubes. The condenser further includes a divider for dividing the condenser shell into first and second condensing chambers. The divider has a plurality of apertures extending therethrough, and the plurality of tubes extend through these apertures. The first compressor, the evaporator, the first condensing chamber, and the first expansion device are to be connected in a first refrigeration circuit, and the second compressor, the evaporator, the second condensing chamber, and the second expansion device are to be connected in a second refrigeration circuit.

The present invention still further comprises a method of operating dual centrifugal compressors. The method comprising the steps of providing a tube and shell condenser with first and second condensing chambers through which extend a common bundle of heat exchanger tubes. This condenser includes a valve in fluid communication with the first and second condenser chambers. The method further includes the steps of selectively applying refrigerant to the shell portion of the first chamber of the heat exchanger with a first centrifugal compressor; selectively applying refrigerant to the shell portion of the second condenser chamber with a second centrifugal compressor; completing a first refrigeration circuit by flowing refrigerant from the first condenser chamber, through an expansion device, and into an evaporator, in fluid communication with the first centrifugal compressor; completing a second refrigeration circuit by flowing refrigerant from the second condenser chamber, through an expansion device, and into an evaporator, in fluid communication with the second centrifugal compressors; and opening the valve when only one of the compressors is on and closing the valve when both of the compressors are on. In the method of the present invention, a single evaporator receives refrigerant from two expansion valves, one for each compressor, and then applies refrigerant to the two compressors. The two compressors may have different capacities, and the relative size of the first and second chambers are selected as a function of the capacity of the two compressors. The compressors also may be variable capacity compressors.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description serve to explain the principles of the invention. In the drawings.

DESCRIPTION OF THE PREFERRED EMBODIMENT

The broad invention is drawn to a system and method of applying dual centrifugal compressors to a single evaporator and a single condenser in a refrigeration chiller unit. The condenser is split into two sections or chambers by a dividing tube support (a divider) having the same cross-sectional shape as the condenser and having holes provided therethrough to accept the heat exchanger tubes of the condenser. These two chambers are interconnected by a piping and valve system that can be selectively opened and closed, to equalize or separate the pressures in the respective chambers. A first compressor serves the first chamber, and a second compressor serves the second chamber. Refrigerant flows from the first and second chambers of the condensers and then through respective first and second expansion devices to an evaporator. This arrangement permits the two centrifugal compressors to be turned off and on, as load conditions require. Regardless of whether one or both compressors are operated, the same amount of cooling fluid can flow through the heat exchanger tubes of the condenser, thereby optimizing the potential heat exchange and efficient use of the cooling fluid.

Reference will now be made in detail to the present preferred embodiment of the invention, an example of which is illustrated in the accompanying drawings. Wherever possible, the same reference numbers will be used throughout the drawings to refer to the same or like parts.

Figure 1:
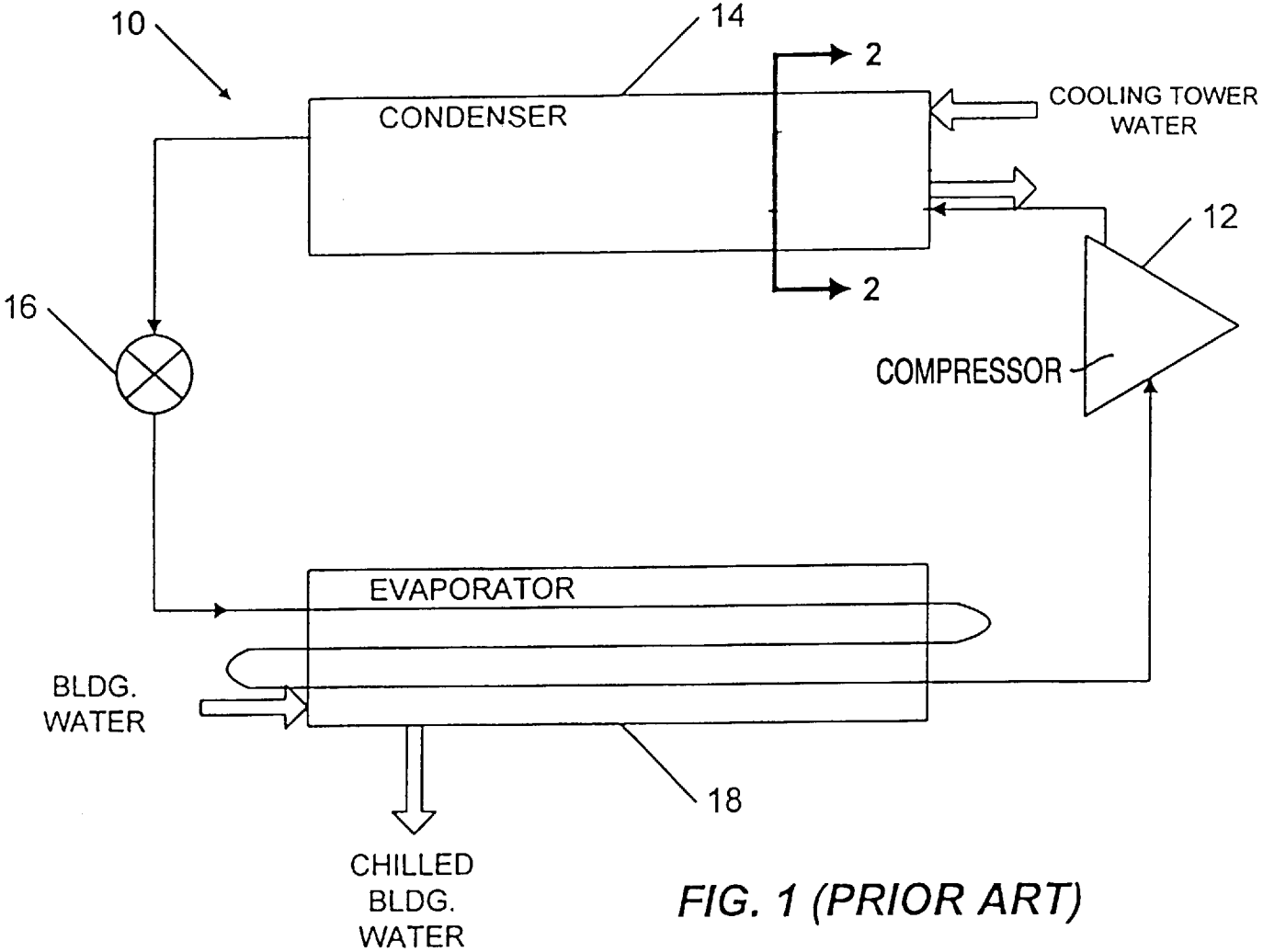
FIG. 1 (PRIOR ART)
FIG. 1 is a block diagram showing a conventional refrigeration system.
Figure 2:
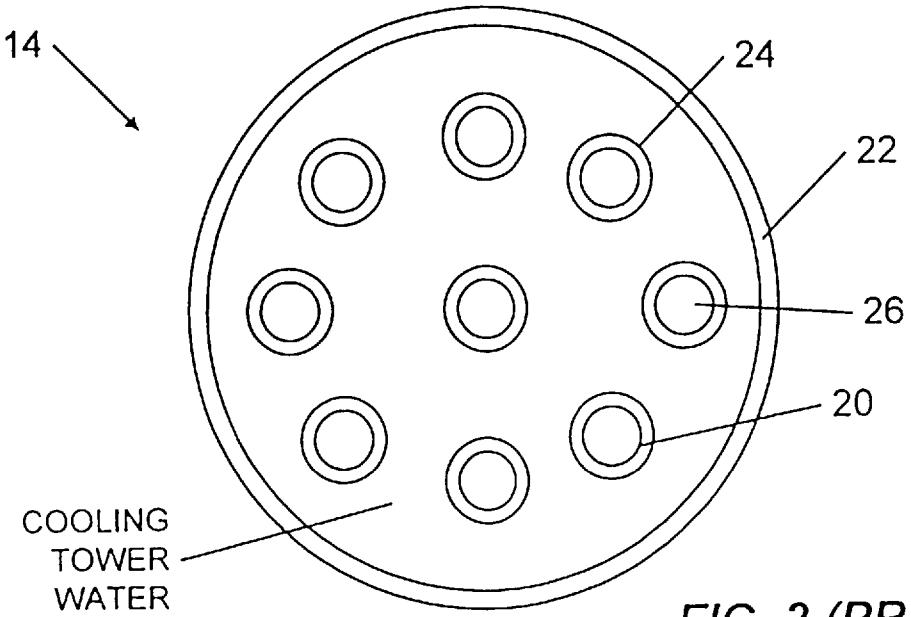
FIG. 2 (PRIOR ART)
FIG. 2 is a section view of the conventional condenser taken along line 2—2 of FIG. 1.
Figure 3:
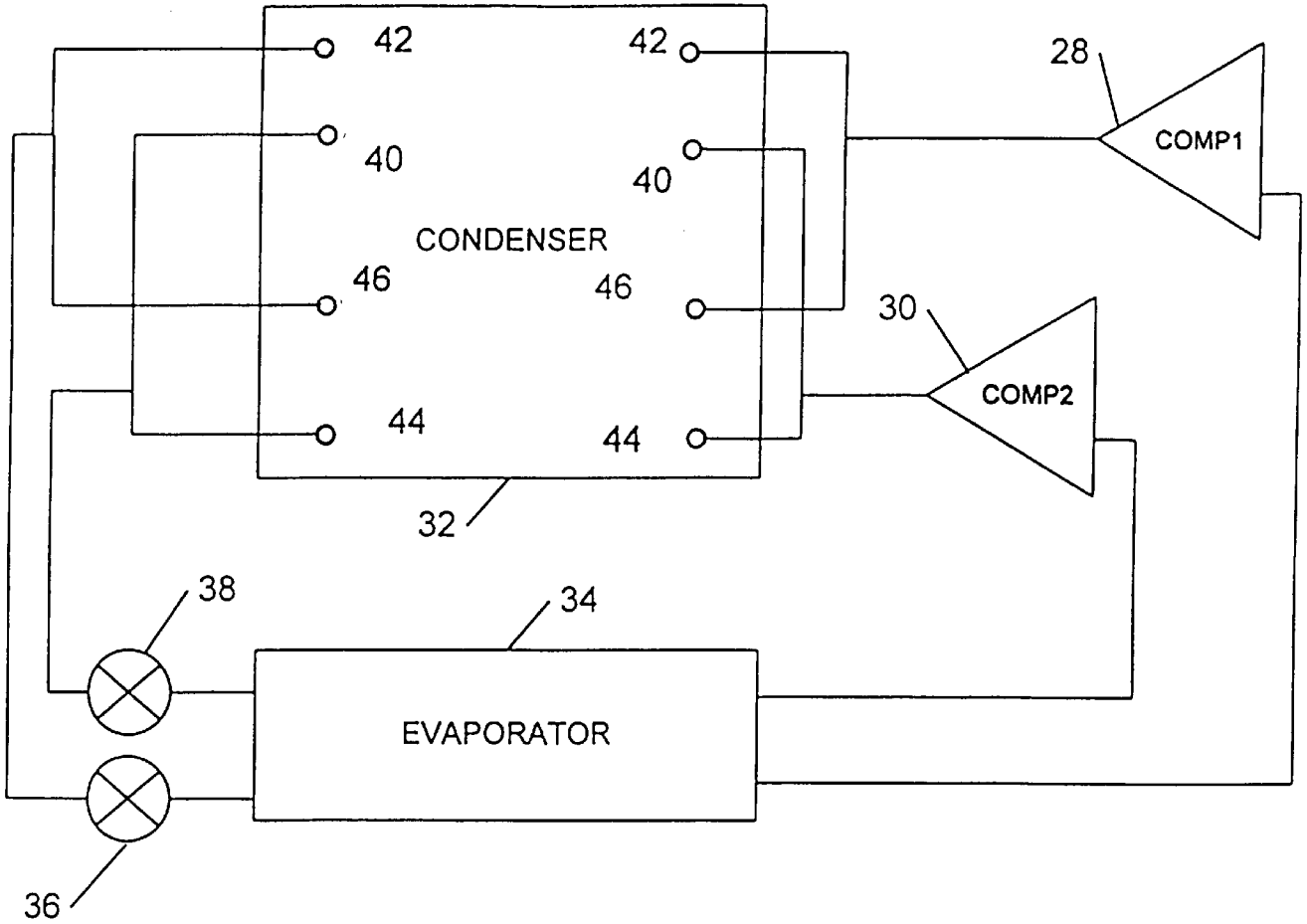
FIG. 3 (PRIOR ART)
FIG. 3 is a block diagram showing a dual-compressor refrigeration system.
Figure 4:
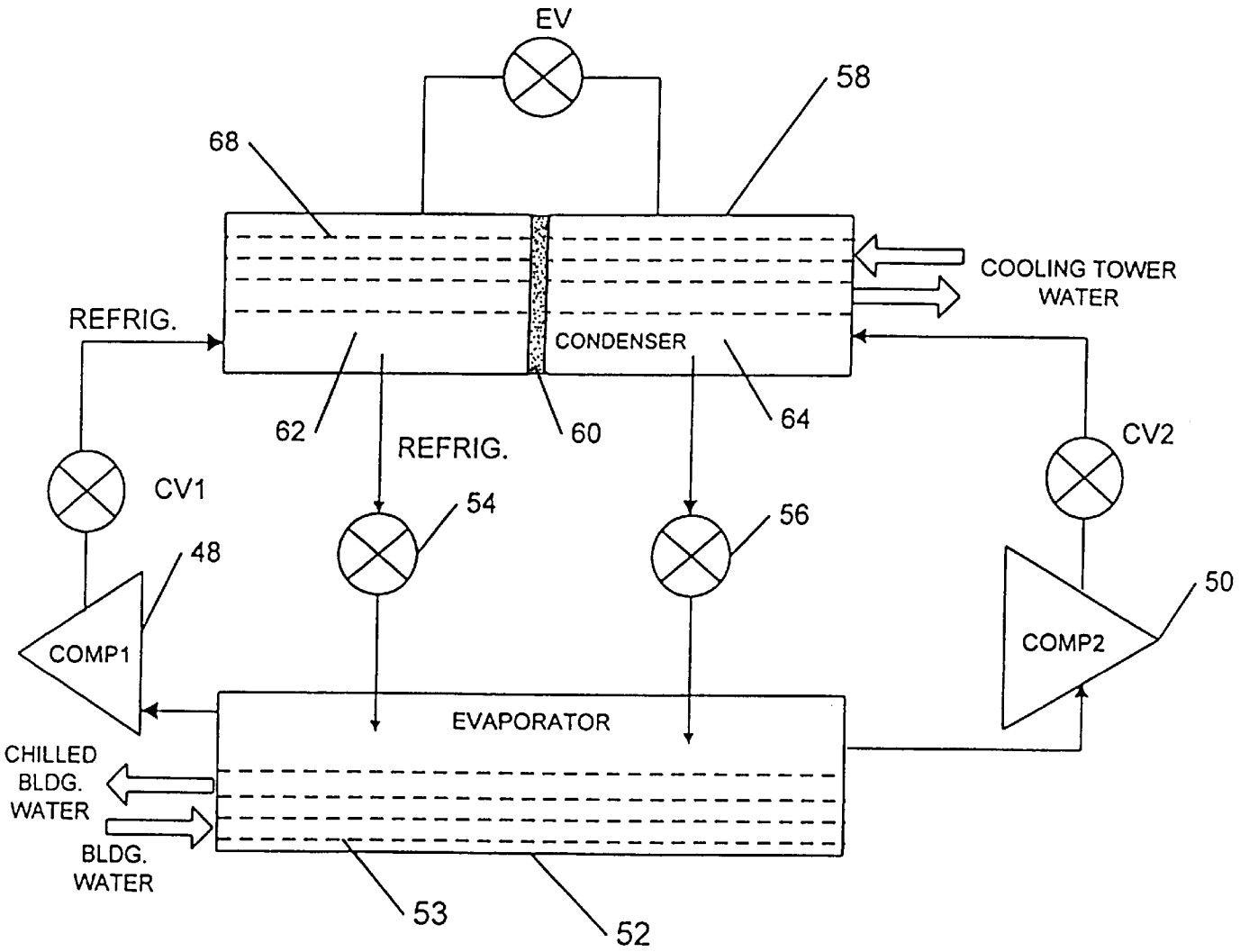
FIG. 4 is a block diagram of a preferred embodiment of the dual centrifugal compressor refrigeration system of the present invention.

In accordance with the objects of the present invention and as shown in FIG. 4, the invention comprises a refrigeration chiller, including first and second centrifugal compressors 48, 50 for compressing refrigerant, a condenser 58 with first and second chambers 62, 64, and an evaporator 52 for evaporating the refrigerant before it enters first and second centrifugal compressors 48, 50. The system further includes first and second expansion valves 54, 56 that accept refrigerant from first and second chambers of a condenser 58 and then expand the refrigerant before it is applied to a common evaporator. These expansion valves 54, 56 are provided in the lines connecting condenser 58 to evaporator 52. The system also preferably includes valves CV2 and CV1 which are check valves, or can be controlled on/off valves, that can selectively close the flow of refrigerant to or from the condenser, when it is not operating.

Condenser 58 includes a dividing tube support 60 for dividing condenser 58 into first and second condensing chambers 62, 64. Dividing tube support 60 may be placed at different positions along the length of condenser 58, depending upon the relative capacity of the compressors serving the condenser shell. Dividing tube support 60 preferably is a metal disc having a plurality of holes formed therethrough, through which a plurality of heat transfer tubes 68 extend. Dividing tube support 60 is sized to be the same or substantially the same as the cross section of the condenser shell, and it fits into the cylindrical condenser, as shown in the FIGS. 4 and 5. While the illustrated divider is circular, it may be formed of any desired shape to fit the cross-section of condenser. Thus, if the condenser had a rectangular-shaped cross section, then the dividing tube support would also be rectangular so to fit within the cross-section of the condenser. The fit between the divider 60 and the inner walls of the condenser, as well as the fit between the holes in the divider and the outer walls of the heat exchanger tubes of the condenser, are close fits that limit or prevent fluid leakage between the two chambers. Preferably, the divider is welded or otherwise fixed to the interior wall of the condenser, and the heat exchanger tubes are closely fit or sealed at their interface with the divider. However, leak proof fits are not required, since relatively close fits will sufficiently separate one chamber from the other, for the purposes of the invention.

As shown in FIG. 4, first and second condensing portions 62, 64 are interconnected when an equalizing valve EV is opened. This valve is preferably an adjustable, multi-position valve that can be selectively open or closed in increments, in response to control signals.

First compressor 48, evaporator 52, first condensing chamber 62, and first expansion device 54 are connected to form a first refrigeration circuit. Likewise, second compressor 50, evaporator 52, second condensing portion 64, and second expansion device 56 are connected to form a second refrigeration circuit. As shown, both of these circuits communicate with each other at the evaporator which accepts refrigerant from both of the expansion valves and applies refrigerant to each compressor. Valves CV1 and CV2 are placed in the refrigerant line connecting the respective first and second compressors to the corresponding first and second compressor chambers. When the valves are open, the refrigerant flows from a given compressor to a chamber in the condenser, out of the condenser to an expansion device, and then to the evaporator. Both the condensers and the evaporator are preferably tube and shell heat exchangers, with the refrigerant being applied to the shell and a fluid, e.g. water, being applied to the tubes. Although the drawings for purposes of simplicity illustrate only a few heat exchanger tubes within the condenser and evaporator, it will be appreciated by those skilled in the art that hundreds or thousands of heat exchanger tubes can be used in the designs of condensers or evaporators, according to the present invention.

Building water, or the like, flows through tubes 53 provided in evaporator 52 and comes in heat transfer contact with the refrigerant vapor flowing through the shell of evaporator 52 outside of tubes 53. The refrigerant vapor enters a suction port of first compressor 48, is compressed and then flows through a first check valve CV1 and into first condensing portion 62 of condenser 58. The refrigerant while in condenser is in heat exchange relationship with a cooling liquid, such as cooling tower water, flowing through a plurality of tubes 68 running through condenser 58. The liquid refrigerant proceeds from first condensing portion 62, through first expansion valve 54, and back into evaporator 52. The building water is chilled and released to the building.

Similarly, the refrigerant vapor from evaporator 52 flows to second centrifugal compressor 50, where it is compressed and fed through a second check valve CV2 into second condensing section 64 of condenser 58. The liquid refrigerant proceeds from second condensing portion 64, where it is in heat exchange relationship with a cooling liquid, through second expansion valve 56, and back into evaporator. The building water is chilled in the evaporator and released to the building.

Figure 5:
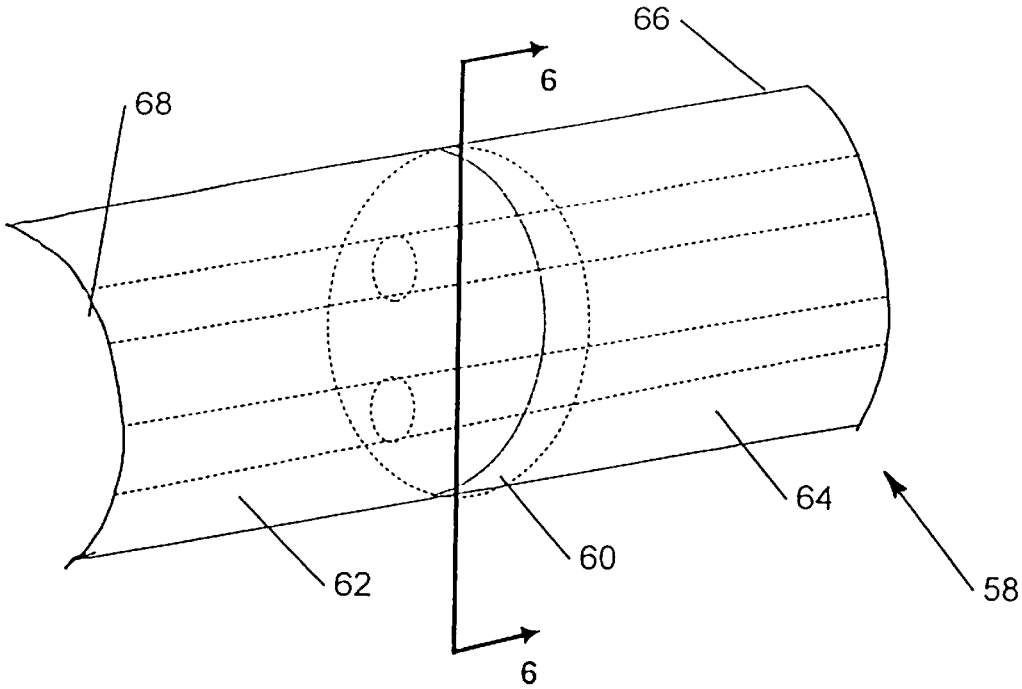
FIG. 5 is a partial view of the condenser shown in FIG. 4.
Figure 6:
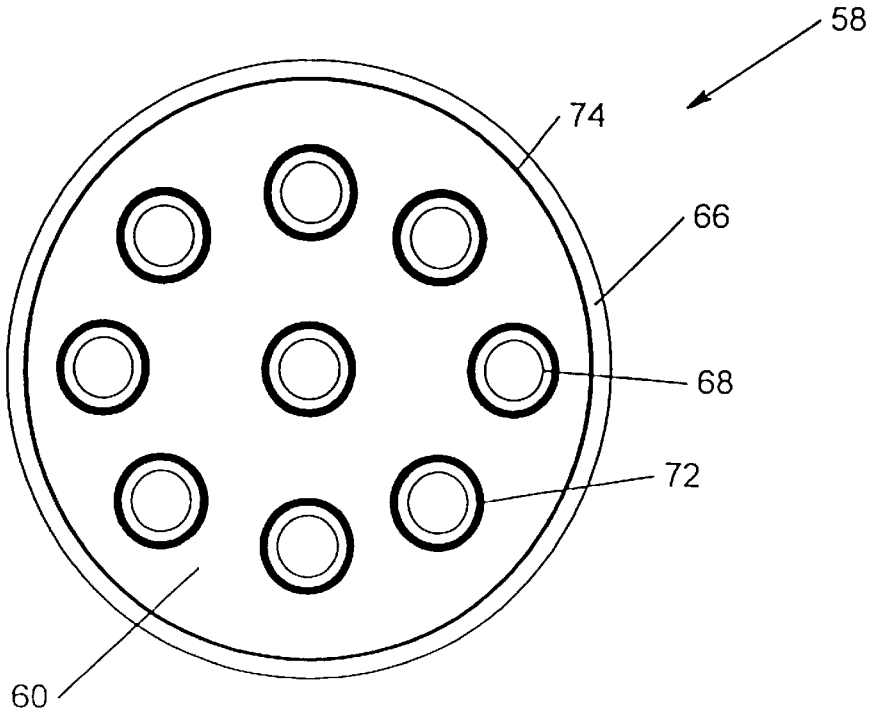
FIG. 6 is a section view of an embodiment of the divider of the condenser taken along line 6—6 of FIG. 5.

As seen in FIGS. 5 and 6, condenser 58 is preferably of the shell-in-tube type, comprising a shell 66 through which refrigerant is passed and a plurality of heat transfer tubes 68 extending through shell 66. Cooling tower water (or a similar cooling medium) passes through the tubes. Heat transfer tubes 68 extend throughout the length of an interior portion of the condenser shell 66. The refrigerant passing through shell 66 contacts an outer surface of heat transfer tubes 68 and is converted into liquid refrigerant.

Through the above disclosed systems two centrifugal compressors can be operated with an independent condenser pressure for each centrifugal compressor. This avoids the problems encountered by the conventional parallel-compressor refrigeration systems. When only one compressor is operating, the EV valve is open. When both compressors are operating, the EV valve remains closed. Furthermore, with the present invention, the refrigeration chiller capacity can be maximized, as well as adjusted to accommodate variable load requirements.

The start-up method of applying the present invention includes a first step of starting the first centrifugal compressor 48, while maintaining equalizing valve EV in an open position and controlling expansion valves 54, 56 with liquid level controllers (not shown) provided in condenser 58. Such liquid level controls are known in the art and cause the expansion valves to open or close in response to the level of liquid refrigerant in the condenser at a given time. Typically, once the level of refrigerant reaches a predetermined level in the condenser, the valve is incrementally opened, to flow more refrigerant to and through the expansion valves. In the embodiment disclosed, each valve 54 and 56 are controlled by a separate liquid level control applied to the condenser chamber served by the valve. As long as one compressor is operating, refrigerant flows from the working compressor, through an open CV valve, to and through the shell of the condenser chamber served by the compressor, then through an expansion valve, and then to and through the shell of the evaporator.

As long as a single compressor provides the desired capacity, the second compressor remains off, conserving energy. One or both of the compressors can be a variable capacity centrifugal compressor, with controls to vary capacity as desired. When a second centrifugal compressor, e.g. compressor 50, must be activated to meet load, the EV valve is closed at a controlled rate to separate one chamber from the other and expansion valve 56 is opened. Second centrifugal compressor 50 is then started, once the pressure of second condenser portion 64 approaches or equals the pressure of evaporator 52. Expansion valve 56 is then controlled by the condenser liquid level controllers associated with the condenser chamber served by the second compressor.

Either of the centrifugal compressors 48, 50 can be shut down by a first shutting down the other centrifugal compressor, opening equalizing valve EV at a controlled rate, and controlling expansion valves 54, 56 with the condenser liquid level controllers. If it is desired, the other centrifugal compressor 48 can be shut down later. With the invention, it is possible to selectively cycle the operation of the compressors, so that the use of and wear on the compressors is more uniform. Moreover, when one or both compressors are variable capacity compressors, the present invention permits selective control over a broad range of capacities.

With the present invention, the two compressors can be selectively turned on and off (or varied), as load conditions warrant. When only one compressor is on, the condenser still effectively utilizes the coolant fluid flowing through the cooling tubes running through condenser 58. Furthermore, the centrifugal compressors of the present invention may have different capacities and/or variable load characteristics to better match the cooling load required by the refrigeration chiller, and thus provide the refrigeration chiller with increased versatility and/or capacity. In the instance where the compressors have different capacities, the position of the divider is preferably selected to provide cooling chambers that best match the capacity of the compressors.

Finally, at low loads, i.e., when refrigerant running through a portion of condenser 58 is providing diminishing capacity, the system of the present invention can be controlled to lower the refrigerant level in condenser 58 while simultaneously raising the refrigerant level in evaporator 52, through control of expansion valves 54, 56. This control scheme enables the chiller to take advantage of the top rows of evaporator tubes that are normally not exposed to liquid refrigerant under low load conditions.

The present invention establishes an independent condenser pressure for each centrifugal compressor, and thus avoids the problems encountered by the conventional parallel compressor refrigeration system. Under the present invention, one of the centrifugal compressors may be shut down during a low load condition, while the operating centrifugal compressor can run and still effectively utilize the cooling capacity of the coolant running through the heat exchanger tubes of the condenser. The invention thus enables effective cooling of the building water without requiring two condensers and the external piping associated with a two condenser system. The present invention can be designed to include dual centrifugal compressors having different capacities (fixed or variable) to better match the cooling load required by the refrigeration chiller. The compressors can be turned on and off by selectively operating the valves, particularly the equalizing valve in fluid communication with both condenser chambers. Under the present invention a control system can be designed to lower the refrigerant level in the condenser while raising the refrigerant level in a chiller evaporator, when loads are low. This will take advantage of the top rows of evaporator tubes that are normally not exposed to liquid refrigerant under low load conditions.

The present invention thus can operate with one or both compressors operating. The invention uses most, if not all, the capacity of the cooling water flowing through the tube bundle of the condenser, even when one compressor operating. The compressors can have different capacities to better match the load profile, and the divider in the condenser can be located to provide chambers that match the capacities of the compressors. The resultant unit is more compact and economical than a two condenser system.

It will be apparent to those skilled in the art that various modifications and variations can be made in the dual centrifugal compressor refrigeration system of the present invention and, specifically, in construction of the condenser without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A refrigeration chiller comprising:

first and second compressors for compressing a vaporous refrigerant;

an evaporator for evaporating the refrigerant;

first and second expansion devices for expanding the refrigerant passing therethrough;

a conductor for condensing the refrigerant, said condenser including a first and second condensing chambers separated from each other, and a plurality of heat exchanger tubes extending along the condenser's length, wherein said first compressor, said evaporator, said first condensing chamber, and said first expansion device are connected to form a first refrigeration circuit, and wherein said second compressor, said evaporator, said second condensing chamber, and said second expansion device are connected to form a second refrigeration circuit; and a valve in fluid communication with each of said first and second condenser chambers for selectively operating to equalize or not equalize the pressures in the two chambers.

2. A refrigeration chiller as claimed in claim 1, wherein each of said compressors is a centrifugal compressor.

3. A refrigeration chiller as claimed in claim 2, wherein the condenser has a common shell along its length and includes a divider between its ends, which divides the shell into said first and second condenser chambers.

4. A refrigeration chiller as claimed in claim 1, further comprising a control which at a low load biases at least one of said first and second expansion valves to lower the refrigerant level in said condenser means while simultaneously raising the liquid refrigerant level in said evaporator means.

5. A refrigeration chiller as claimed in claim 3, wherein the first and second centrifugal compressors have different capacities and said divider is positioned along the length of the condenser, according to the relative capacities of the compressors.

6. A refrigeration chiller as claimed in claim 3, wherein the divider has a cross-section substantially the same as the cross-section of said condenser and includes a plurality of holes through which a plurality of heat exchanger tubes of said condenser extend.

7. A refrigeration chiller as claimed in claim 3, wherein the divider is positioned along the lengths of said condenser, according to the relative capacities of the compressors with which the respective condenser chambers will be used.

8. A condenser for use in a refrigeration chiller having first and second centrifugal compressors, an evaporator, and first and second expansion devices for expanding a refrigerant passing therethrough, comprising:

a shell through which the refrigerant is passed;

a plurality of heat transfer tubes extending through said shell, said heat transfer tubes extending throughout substantially the entire length of the interior of said shell;

a divider within said condenser shell that separates the condenser into first and second condensing chambers, said divider having a cross section substantially the same as the cross section of the shell and having a plurality of holes through which the plurality of tubes extend; and a valve in fluid communication with each of said first and second condenser chambers for selectively operating to equalize or not equalize the pressures in the two chambers.

9. A method of operating a dual centrifugal compressors in a closed refrigeration chiller, the method comprising the steps of:

providing a tube and shell condenser with first and second condensing chambers through which extend a common bundle of heat exchanger tubes, said condenser including a valve in fluid communication with the first and second condenser chambers;

selectively applying refrigerant to the shell portion of the first chamber of the heat exchanger by a first centrifugal compressor, selectively applying refrigerant to the shell portion of the second condenser chamber by a second centrifugal compressor, completing a first refrigeration circuit by flowing refrigerant from the first condenser chamber, through an expansion device, and into an evaporator, in fluid communication with the first centrifugal compressor;

completing a second refrigeration circuit by flowing refrigerant from the second condenser chamber, through an expansion device, and into an evaporator, in fluid communication with the second centrifugal compressor, and opening the valve when only one of the compressors is on and closing the valve when both of the compressors are on.

10. The method as claimed in claim 9, wherein a single evaporator receives refrigerant from two expansion valves, one for each compressor, and applies refrigerant to the two compressors.

11. A method as claimed in claim 9, wherein the compressors have different capacities and further comprising the step of varying the relative sizes of said first and second condenser chambers, as a function of the capacity of the two compressors.

12. A method as claimed in claim 11, further comprising the step of decreasing the level of refrigerant in the condenser while simultaneously increasing the level of refrigerant in the evaporator, when only one compressor is on.

* * * * *